US011050190B2

(12) United States Patent
Changsrivong et al.

(10) Patent No.: US 11,050,190 B2
(45) Date of Patent: Jun. 29, 2021

(54) ELECTRICAL CONNECTORS WITH LINEAR SPRINGS AND RELATED METHODS

(71) Applicant: Bal Seal Engineering, LLC, Foothill Ranch, CA (US)

(72) Inventors: Derek Changsrivong, Foothill Ranch, CA (US); Tony Quach, Fullerton, CA (US)

(73) Assignee: Bal Seal Engineering, LLC, Foothill Ranch, CA (US)

( * ) Notice: Subject to any disclaimer, the term of this patent is extended or adjusted under 35 U.S.C. 154(b) by 193 days.

(21) Appl. No.: 15/612,664

(22) Filed: Jun. 2, 2017

(65) Prior Publication Data

US 2017/0352984 A1 Dec. 7, 2017

Related U.S. Application Data

(60) Provisional application No. 62/344,908, filed on Jun. 2, 2016.

(51) Int. Cl.

| | |
|---|---|
| ***H01R 13/17*** | (2006.01) |
| ***H01R 13/187*** | (2006.01) |
| ***H01R 13/631*** | (2006.01) |
| ***H01R 43/26*** | (2006.01) |

(52) U.S. Cl.

CPC ..... *H01R 13/631* (2013.01); *H01R 13/17* (2013.01); *H01R 13/187* (2013.01); *H01R 43/26* (2013.01)

(58) Field of Classification Search

CPC .... H01R 13/17; H01R 13/187; H01R 4/4854; H01R 4/4863; H01R 4/4872; H01R 4/48; H01R 13/629

USPC ..... 439/310, 370, 816, 839–842, 847

See application file for complete search history.

(56) References Cited

U.S. PATENT DOCUMENTS

| | | | | |
|---|---|---|---|---|
| 3,174,500 A | | 3/1965 | Johnson et al. | |
| 4,183,598 A | * | 1/1980 | Oude Aarninkhof | H01R 13/187 439/17 |
| 4,245,881 A | * | 1/1981 | Michaels | H01R 13/187 439/841 |
| 4,678,210 A | | 7/1987 | Balsells | |
| 4,714,441 A | * | 12/1987 | Corman | H01R 13/187 439/842 |
| 4,872,710 A | | 10/1989 | Konecny et al. | |

(Continued)

FOREIGN PATENT DOCUMENTS

| | | |
|---|---|---|
| DE | 19807663 | 9/1999 |
| GB | 2194298 | 3/1988 |
| WO | WO 03067713 | 8/2003 |

*Primary Examiner* — Renee S Iuebke
*Assistant Examiner* — Paul Baillargeon
(74) *Attorney, Agent, or Firm* — Klein, O'Neill & Singh, LLP

(57) ABSTRACT

Connector assemblies having a housing, a pin, and a spring length having two free ends are used as a mechanical connector to secure two objects or components together or an electrical connector for placing two sources in electrical communication with one another. The spring length can be a canted coil spring in which the two free ends are not connected to one another and the coils can have an elliptical shape or a complex coil shape. The spring length can be used with a retaining component, can be used in a recessed slot formed with the housing or the pin, or both with a retaining component and with a recessed slot.

24 Claims, 7 Drawing Sheets

(56) References Cited

U.S. PATENT DOCUMENTS

| | | | | |
|---|---|---|---|---|
| 4,966,564 | A * | 10/1990 | Foote | A61N 1/3752 439/840 |
| 5,411,348 | A | 5/1995 | Balsells | |
| 5,456,621 | A * | 10/1995 | Gan | H01R 13/17 439/700 |
| 5,545,842 | A | 8/1996 | Balsells | |
| 6,672,565 | B2 | 1/2004 | Russell | |
| 6,835,084 | B2 | 12/2004 | Poon et al. | |
| 7,538,289 | B2 | 5/2009 | Carroll | |
| 7,722,415 | B2 | 5/2010 | Changsrivong | |
| 7,914,315 | B2 | 3/2011 | Kuhn et al. | |
| 7,914,351 | B2 | 3/2011 | Balsells et al. | |
| 8,052,459 | B2 | 11/2011 | Smith et al. | |
| 8,096,842 | B2 | 1/2012 | Poon et al. | |
| 8,308,167 | B2 | 11/2012 | Balsells et al. | |
| 8,382,532 | B2 | 2/2013 | Sjostedt et al. | |
| 8,491,345 | B2 * | 7/2013 | Leon | H01R 13/17 439/817 |
| 8,491,346 | B2 | 7/2013 | Sjostedt et al. | |
| 8,561,274 | B2 | 10/2013 | Balsells | |
| 9,004,805 | B2 | 4/2015 | Changsrivong et al. | |
| 9,267,526 | B2 | 2/2016 | Balsells | |
| 9,284,970 | B2 | 3/2016 | Dilmaghanian et al. | |
| 9,312,630 | B2 | 4/2016 | Huang | |
| 9,482,255 | B2 | 11/2016 | Changsrivong et al. | |
| 9,500,211 | B2 | 11/2016 | Changsrivong | |
| 9,534,625 | B2 | 1/2017 | Balsells | |
| 9,677,587 | B2 | 6/2017 | Changsrivong et al. | |
| 2002/0122690 | A1 | 9/2002 | Poon et al. | |
| 2003/0096526 | A1 | 5/2003 | Balsells | |
| 2013/0149031 | A1 | 6/2013 | Changsrivong et al. | |

* cited by examiner

ELECTRICAL CONNECTORS WITH LINEAR SPRINGS AND RELATED METHODS

FIELD OF ART

The present invention is generally directed to electrical connectors for transmitting electrical signals or power with specific discussions on electrical connectors with linear springs and related methods.

BACKGROUND

Electrical connector assemblies that use a housing, a pin, and a spring are staples of various electronic devices. The connectors allow two different nodes or sources to be connected to one another and permit electrical communication between the two. However, they can be bulky or have other drawbacks. Non-spring based connectors are also commercially available for connecting two different nodes or sources. They can include pin and socket, soldering, clamps, detents, etc.

Electronics such as televisions, smartphones, tablets, electrical circuits for automobiles, aircrafts, sea-crafts, satellites, medical devices, etc., all use electrical connector assemblies. Thus, a suitable electrical connector must be robust and dependable.

SUMMARY

Aspects of the present disclosure are directed to connector assemblies, which can be used as a mechanical connector to secure two objects or components together or an electrical connector for placing two sources in electrical communication with one another.

A connector assembly of the present disclosure can comprise a housing comprising a body with a wall thickness; a retaining component comprising a ring, a finger, and a spring length with two free ends that are spaced from one another located with the finger, and a pin with a tapered insertion end is positioned through the ring; and wherein the spring length with two free ends contact the pin and the finger.

The pin can comprise a recessed slot and the spring length can be positioned, at least in part, in the recessed slot of the pin.

The housing can comprise a recessed slot and the spring length can be positioned, at least in part, in the recessed slot of the housing.

The he ring of the retaining component can have a gap to enable the ring to expand or contact.

The finger can be a first finger and the spring length can be a first spring length.

The connector assembly can comprise a second finger connected to the ring of the retaining component and a second spring length and wherein the second spring length can be located with the second finger.

The recessed slot can comprise two sidewalls, a bottom wall located between the two sidewalls, and two end walls connected to the two sidewalls.

At least one of the two sidewalls can be a tapered sidewall and can be tapered relative to the bottom wall.

The ring of the retaining component can contact an interior surface of the housing before the pin is inserted in a bore of the housing or the ring can contact the pin before the pin is inserted in a bore of the housing.

The he recessed slot can be a first recessed slot, and further comprising a second recessed slot located on the pin, said second recessed slot can comprise two sidewalls.

The finger can be unitarily formed with the ring of the retaining component.

The finger of the retaining component can have a first bend, a second bend, and a free end that points in a direction of the ring and away from the second bend.

The spring length can be a canted coil spring length comprising a plurality of interconnected coils all canted in a same general direction and the housing has a round housing wall or has a polygonal shaped housing wall.

The spring length can be a canted coil spring with a complex coil shape.

The coils can be positioned in a recessed slot having a dovetail groove or a T-shape groove.

The retaining component can be formed from a wire or by stamping a metal sheet with one or more cutting dies.

The finger can have a bend connected to the ring and a free end pointing away from the ring and having a bent retaining tip.

The housing can comprise a body with a wall thickness, an exterior surface, and an interior surface defining a bore; and wherein a recessed slot can be formed with the housing or the pin.

The pin can be rotatable about a lengthwise axis of the pin to separate from the bore of the housing.

A further aspect of the present disclosure include a connector assembly comprising: an housing comprising a body with a wall thickness, an exterior surface, and an interior surface defining a bore; a pin comprising a tapered insertion end and an exterior surface; a spring length having free ends that are not connected positioned in a slot and the spring length is located between and in contact with the interior surface of the housing and the pin to complete an electrical path.

The slot can be formed in the wall thickness of the housing or in the pin. The slot can have a complex cross-sectional shape to receive a canted coil spring with a complex coil shape as disclosed in US Publication No. 2017/0025779.

The slot can have two sidewalls and a bottom wall located therebetween.

The connector assembly can utilize a housing with a unitarily formed finger.

Two sidewalls of the slot can be generally parallel to one another or at least one of the two sidewalls can be a tapered sidewall and is tapered relative to the bottom wall.

The pin is rotatable about a lengthwise axis of the pin to separate from the housing, the rotation can cause a tapered sidewall to lift a plurality of interconnected canted coils.

The pin can have a round cross-sectional shape or a polygonal shape.

Aspects of the present invention include a method of using a connector assembly. The method of using can comprise: inserting a pin having a tapered insertion end into a bore of a housing having an exterior surface and an interior surface or inserting a pin having a tapered insertion into a bore of a ring of retaining component having two fingers extending from the ring; contacting a spring length having two free ends that are not connected with the interior surface of the housing and the pin or contacting two spring lengths each with two free ends and each mounted on a respective one of the two fingers of the retaining component with the pin; wherein the spring length or the two spring lengths each is a canted coil spring comprising a plurality of interconnected coils.

The ring of the retaining component can be fastened to a hardware.

Aspects of the present invention can include a method of making a connector assembly and components of a connector assembly as described herein.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of electrical connector assemblies provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1A:
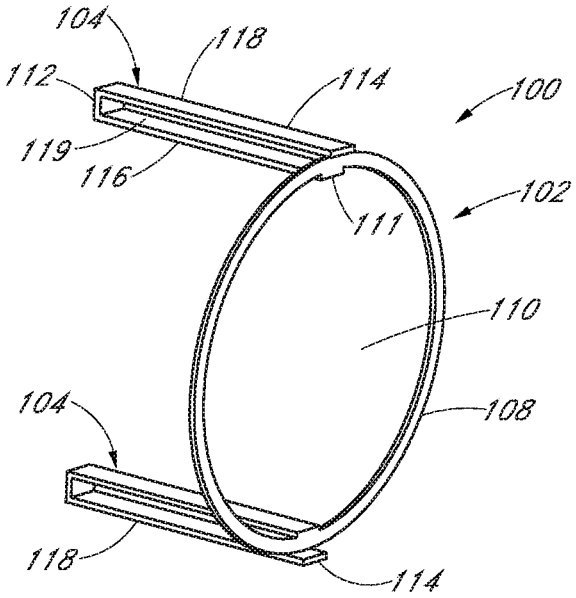
FIG. 1A is a perspective view of a retaining component.

FIG. 1A shows a retaining component 100 for an electrical connector comprising a ring 102 and one or more fingers or tabs 104, which can be used synonymously. As shown, the two fingers 104 extend from the ring 102. In other examples, there can be more than two fingers extending from the ring 102. In an example, the ring 102 can an annular body 108 made from a metal material and has an open or hollow center 110, said body defining a plane. The two fingers 104 can extend in a generally perpendicular direction from the plane and the ring 102 can have a shape that is other than round to fit against or onto a correspondingly shaped housing or pin. In some examples, the one or more fingers 104 can extend at an angle other than perpendicular to accommodate the corresponding structure of the electrical connector, as further discussed below.

The ring 102 and the two fingers 104 extending from the body 108 defining the ring can be made by a stamping process. For example, the retaining component 100 can be made by using one more cutting dies and one or more punching steps to press the one or more dies through a metal sheet to form the ring 102 and the one or more tabs 112. The tabs or fingers 112 can then be post-stamped processed to form a final configuration, such as how the one or more fingers 104 should be positioned relative to the ring 102. In other examples, the fingers are separately formed from the ring 102 and then subsequently attached to the ring, such as by welding. Still alternatively, the one more fingers can be formed with the ring, such as by stamping, with a first length. Additional lengths can then be added, such as by welding, to the one or more fingers that are unitarily formed with the ring with a first shortly length.

The retaining component 100 is therefore understood as a component that can be made by stamping a single stamped metal sheet, such as a single conductive metallic material, which can have a single metal layer or a multi-metallic layer. The ring 102 can have a central axis passing through a center 110 thereof. As shown in FIG. 1A, after the stamping process with one or more dies, the elongated tab 104 that forms the finger is then bent at a first bend 111 so that its lengthwise direction extends generally co-axially with the central axis of the ring. If the tab 104 is longer than the desired final length of the housing, then the tab can have a second bend 112 so that a free end 114 of the tab 104 is turned towards the ring 102 or in the direction of the ring. In some examples, the tab is stamped with an appropriate length so that a second bend can be omitted.

Where a second bend 112 is incorporated, the width or overall thickness profile of the finger 104 is wider than the thickness of the metal sheet from which the finger is stamped. The finger with the second bend has a first finger portion or section 116 that connects to the ring 102 and a second finger portion or section 118 having a free end 114 with an optional bent retaining lip. As further discussed below, the one or more fingers 104 can each accommodate a length of canted coil spring. The spring length, which can be a canted coil spring, such as a radial canted coil spring, an axial canted coil spring, or a hybrid canted coil spring with both radial and axial canting components, can have two free ends or two ends that are not connected to one another mounted on the finger 104 with the finger projecting through the coil center of the canted coil spring length. Where the finger has a second bend 112, the first finger section or portion 116 can project through the coil centerline of the spring length. In other examples, the second figure section or portion 118 can extend through the coil centerline of the spring length.

A canted coil spring is understood as a spring that has a plurality of interconnected coils that all cant generally in the same direction. The canted coil spring differs from traditional compression or extension helical springs, which cannot cant in the radial direction between the two free ends of the spring length. In the embodiments of the present invention, canted coil spring sections in a spring length configuration with two free ends are used with the connector assemblies. The length of the spring section can vary as desired.

As shown in FIG. 1A, each of the two fingers 104 is bent multiple times to produce a complex shape having two or more bent angles or bent sections and two bends. In other examples, a single bent is provided to turn the stamped elongated piece so that it aligns with the central axis of the ring. As shown, each of the two fingers 104 has an upper or outer finger section 118 that is generally parallel with a lower or inner finger section 116. The two finger sections 116, 118 define a gap 119 therebetween.

In an alternative embodiment, the retaining component 100 can be made from a wire, or from one or more wire sections. For example, a wire can have two ends. A ring can be formed using the wire and where the first end comes together to enclose the ring, the first end can be intertwined with the wire section to secure the ring. The other free end can then extend from the ring to form a finger for holding a canted coil spring section, said spring section have two free ends.

Figure 1B:
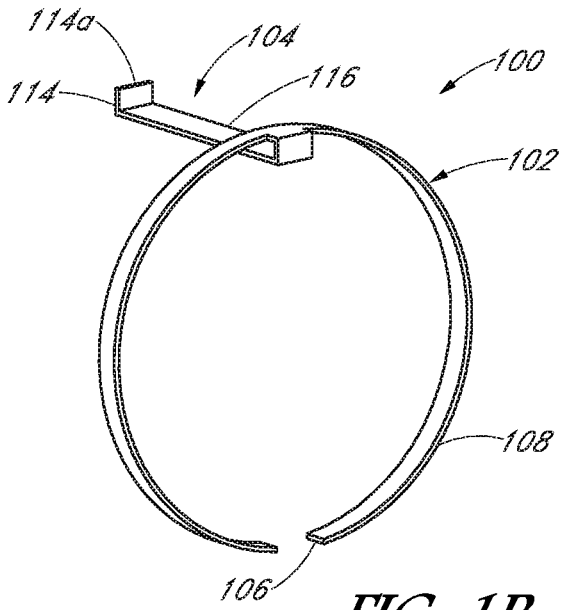
FIG. 1B is a perspective view of another retaining component.

FIG. 1B shows an alternative a stamped retaining component 100 for use with an electrical connector. In the present embodiment, the body 108 defining the ring 102 is not continuous. As shown, the body 108 has a gap 106 to enable the body to collapse until the two ends at the gap 106 contact or expand to further enlarge the gap. The ring 102 can thus act like a snap ring. The present retaining component 100 is shown with a single finger 104. Further, the finger 104 is shown with a single finger section 116 having a bent free end 114 with a bent retaining lip 114*a*. The free end 114 is understood to be an end part of the finger that is free to move or deflect and not constrained by another component or element and does not necessarily mean the end most point of the finger. The retaining lip 114*a* can be optional. In other examples, the free end 114 is provided with a detent for engaging a corresponding detent to retain the spring length, rather than incorporating a unitarily formed retaining lip. The retaining component 100 of FIG. 1B is shown with one finger with additional fingers contemplated. When multiple fingers are incorporated with a retaining component 100, for the present embodiment or for other retaining components discussed elsewhere herein, the fingers can be equally spaced around the body of the ring or un-equally spaced.

Figure 1C:
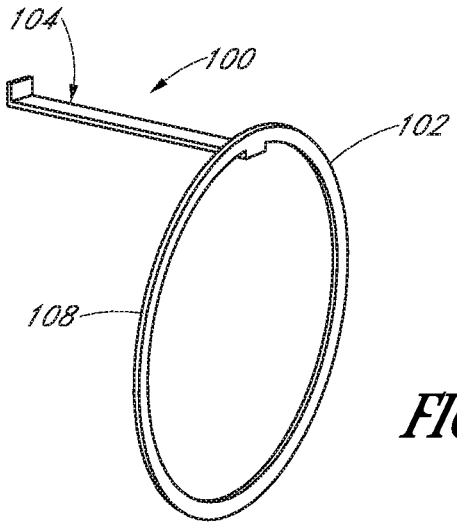
FIG. 1C is a perspective view of another retaining component.

FIG. 1C shows yet another alternative retaining component 100 for an electrical connector application in which the ring 102 is formed with a continuous ring body 108, without a gap and by stamping a metal sheet, like that of FIGS. 1A and 1B. In less preferred embodiments, the retaining component 100 described herein can be machined with or without post-machined welding, such as to attached a finger.

The retaining component 100 of FIG. 1C has a single finger 104 extending from the ring. In other examples, two, three, or more than three fingers can be provided and extend from the ring 102. The ring can have a gap or no gap. The finger 104 is shown with a single finger section 116 having a bent free end 114 with a bent retaining lip 114*a*.

Figure 2:
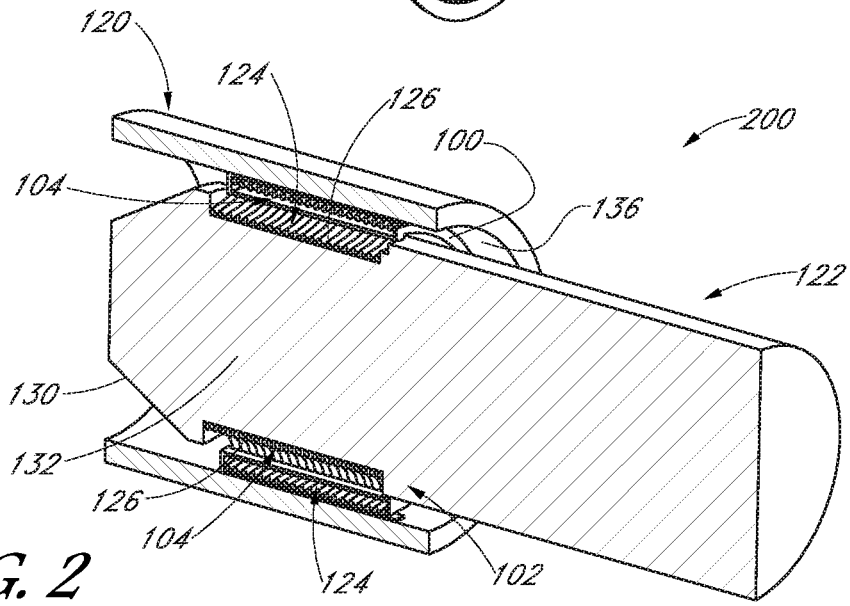
FIG. 2 is a perspective cross-sectional side view of an electrical connector assembly.

FIG. 2 shows a connector assembly 200 comprising a housing 120, a pin 122, a stamped retaining component 100 as provided herein, and at least two spring sections 124 located on each of the at least two fingers 104 extending from a ring 102 of the retaining component 100. In other embodiments, the retaining component 100 can have a single finger for supporting a single spring section 124. Unless indicated otherwise, each canted coil spring section 124 has two free ends that are not connected. The housing 120 can embody an elongated cylinder section with at least one open inlet for receiving the pin and an optional open outlet at the opposite end of the housing. The housing can have a continuous wall in the radial direction or around the circumference or can have a gap. If a gap is incorporated, the gap can be up to about 40% of the total circumference of the housing. By limiting the gap to less than 50% of the total circumference, the pin 122 cannot slip out through the gap.

The pin 122 can be provided with at least two recessed slots or recessed channels 126 for accepting or receiving the at least two spring sections or lengths 124, one in each slot 126. The retaining component 100 can be oriented so that the two fingers 104 having the two spring lengths 124 mounted thereon, one spring length per finger, are aligned with the two channels 126 formed on the pin 122. The pin 122 can incorporate a shoulder to abut against a surface of the housing 120, such as the axial end at the housing inlet, to limit the insertion of the pin inside the bore of the housing.

In the connected position of FIG. 2, the spring lengths, which can be canted coil springs each with a plurality of interconnected coils that cant generally in the same canting direction, are biased by the surfaces of the two channels 126 and the interior surface of the housing 120. In an electrical connector application, electric current or signal can pass between the housing 120 and the pin 122 via the one or more spring lengths 124. In some examples, where two or more different spring lengths are utilized with the contact assembly, the spring lengths can be of the same length or different lengths, such as one being longer than the other.

Unless the context indicates otherwise, the housing, the pin, the spring section or sections, and the retaining component, the latter when utilized, can all be made of commercially available electrically conductive material or materials. Where an application is not electrically related, one or more of the connector assembly components can be made from a non-conductive material.

Aspects of the present invention are understood as being capable of electrical and dynamic applications. The present connector may also be suitable for use in EMI applications, such as for shielding EMI interference.

In an example, the pin 122 has a lengthwise axis and each slot or recessed channel 126 is formed lengthwise and aligned with the lengthwise axis of the pin. The pin has a planar end surface with a tapered insertion end 130 and a solid core 132. The pin can have a length and a diameter that are sized and shaped for use as a pin for electrical applications. Further, the fingers on the retaining component 100 can be arranged to align with the slots. The annular gap or clearance gap 136 between the exterior surface of the pin 122 and the interior surface defining the bore of the housing 120 can be adjusted based on the selected spring sections 124. For example, when the spring lengths have large coils and large spacing between the coils, the clearance gap 136 can be correspondingly large. The clearance gap 136 can also be non-uniform around the space between the housing and the pin. For example, when a single spring section is utilized or when multiple spring sections are utilized but spaced unequally around the circumference of the pin or the interior bore of the housing, the clearance gap 136 is non-uniform.

The stamped retaining component 100 can press fit into the bore of the housing 120. For example, the outer circumference of the ring 102 of the retaining component 100 can press into the bore of the housing. In other examples, the fingers 104 can have finger sections that extend radially outwardly of the outer circumference of the ring 102 to bias against the interior surface of housing 120. The fingers can bias against the housing with a retaining force to retain the retainer component 100 against the interior of the housing. In yet another example, the ring with the gap 106 of FIG. 1B is used with the housing 120 of FIG. 2 and the gap allows for flexing of the body of the ring in the interior of the housing or around the exterior of the pin.

In an example, the retaining component 100 with spring lengths or sections 124 located with the fingers 104 is first installed inside the bore of the housing 120. The pin 122 is then inserted into the hollow central region 110 of the ring 102 until the two spring sections 124 snap into the two slots or recessed channels 126 formed with the pin 122. In some examples, alignment features can be provided on the pin 122, the retaining component 100, the outer housing 120, on all three components, or on one, two or more of the components to facilitate setting of the spring sections into the slots on the pin 122. For example, markers, indicators, guide pins, grooves, channels, etc. may be used to facilitate alignment of the various connector components.

In an example, the pin 122 is made from a conductive material and optionally can be coated or plated with a conductive outer layers or materials. The pin 122 has a tapered insertion end 130 to facilitate insertion of the pin into the ring 102 of the retaining component 100 and consequently into the housing 120. Although not shown, other electrical or electronic components can connect to the housing and to the pin to then connect to one another. For example, a power source can connect to the pin 122 and a circuit board can connect to the housing 120 so that power can be supplied to the circuit board via the electrical path through the pin, the one or more spring lengths or sections, and the housing.

For the connector assemblies and connector assembly components disclosed herein, it is understood that where a feature is shown but not expressly described and is otherwise the same or similar to the feature or features described elsewhere, such as above with reference to FIGS. 1A-2, the disclosed part or parts shown in all the drawing figures but not expressly described because of redundancy and because knowledge is built on a foundation laid by earlier disclosures may nonetheless be understood to be described or taught by the same or similar features expressly set forth in the text for the embodiments in which the feature or features are described. Said differently, subsequent disclosures of the present application are built upon the foundation of earlier disclosures unless the context indicates otherwise. The disclosure is therefore understood to teach a person of ordinary skill in the art the disclosed embodiments and the features of the disclosed embodiments without having to repeat similar components and features in all embodiments since a skilled artisan would not disregard similar structural features having just read about them in several preceding paragraphs nor ignore knowledge gained from earlier descriptions set forth in the same specification. As such, the same or similar features shown in the following connector assemblies incorporate the teachings of earlier embodiments unless the context indicates otherwise. Therefore, it is contemplated that later disclosed embodiments enjoy the benefit of earlier expressly described embodiments, such as features and structures of earlier described embodiments, unless the context indicates otherwise.

Figure 3A:
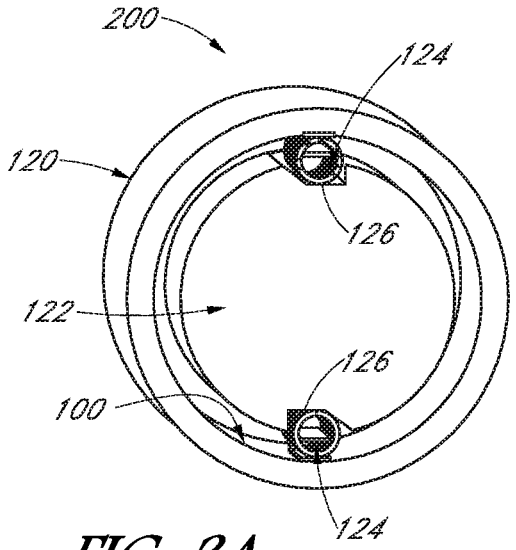
FIGS. 3A-3C are perspective, detailed, and cross-sectional side views, respectively, of an electrical connector having spring sections located on fingers of a retaining component.

FIG. 3A shows an end view of the elongate cylinder section of a housing 120 and the retaining component 100 of the connector component or assembly of FIG. 2, in an end view, along with a pin 122. In an example, the two spring lengths 124 define an inside clearance gap between them. The tip of the tapered insertion end 130 of the pin 122 (FIG. 2) has a smaller dimension than the inside clearance gap defined by the two spring sections so that upon insertion of the pin, the tapered insertion end of the pin lifts the two canted coil spring sections, which is understood to mean a further canting of the coils of the two spring sections, to allow the pin to be fully inserted in through the ring 102 and into the bore of the housing 120 to complete the connection with the housing. As previously discussed, the two spring sections 124 are configured to snap into the two recessed channels 126 formed with the pin 122.

Figure 3B:
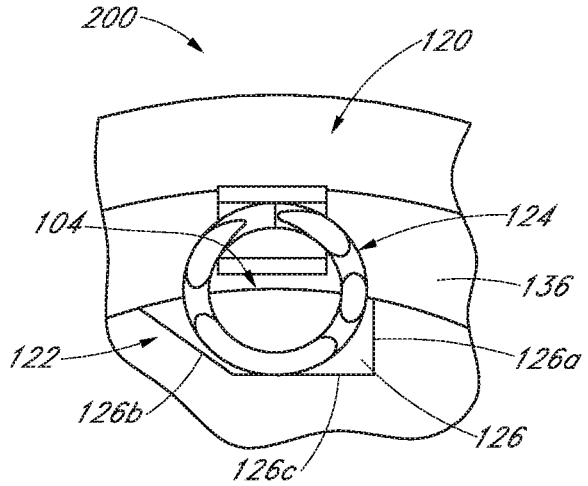

FIG. 3B is a close up end view of one of the spring sections 124 of FIG. 3A located on a finger 104 and the spring section 124 is situated in a slot 126 formed with the pin 122. A clearance gap or annular space 136 is provided between the pin and the housing. The slot 126 is shown having two sidewalls 126*a*, 126*b*, and a bottom wall 126*c* located therebetween. As shown, one of the two sidewalls of the slot is tapered 126*b* relative to the bottom wall 126*c* whereas the other sidewall 126*a* forms generally a right angle with the bottom wall 126*c*.

In some examples, both sidewalls 126*a*, 126*b* can be tapered relative to the bottom wall 126*c* or both sidewalls 126*a*, 126*b* can be straight, such as having generally a right angle with the bottom wall 126*c*. The tapered sidewall 126*b* can vary between 1 degree to 89 degrees with the bottom wall, with 89 degrees being almost perpendicular with the bottom wall and 1 degree being almost flat with the bottom wall, with about 25 degrees to 55 degrees being an acceptable or workable exemplary range. In some examples, the bottom wall 126*c* can be slanted or tapered. In still other examples, the channel can have a V-shape or a V-shape with a subtended surface between the two slanted surfaces of the V-shape.

In the connected position between the pin, housing, and retaining component shown in FIG. 3B, the spring 124 is biased or compressed by at least two surfaces. For example, the spring section 124 is biased by the bottom wall 126*c* of the slot 126 and by an upper or outer finger section 118 of the retaining component 100. When biased by the two surfaces, the coils are further deflected from the coils' original canting position and further canted from a first canting angle to a second canting angle. As further discussed below, by selecting the appropriate recessed channel configuration, such as a whether to include a tapered sidewall, two vertical walls, a V-shape groove, etc., the pin 122 can be adapted to lock to the housing 120 and cannot be removed therefrom without destroying the spring sections or can be latched to the housing with the ability to be removed from the housing without destroying the spring sections.

In some examples, rather than biasing the coils against an outer finger section, the spring section is biased by an interior surface of the outer housing, such as when using the simple finger shape of FIGS. 1B and 1C.

Figure 3C:
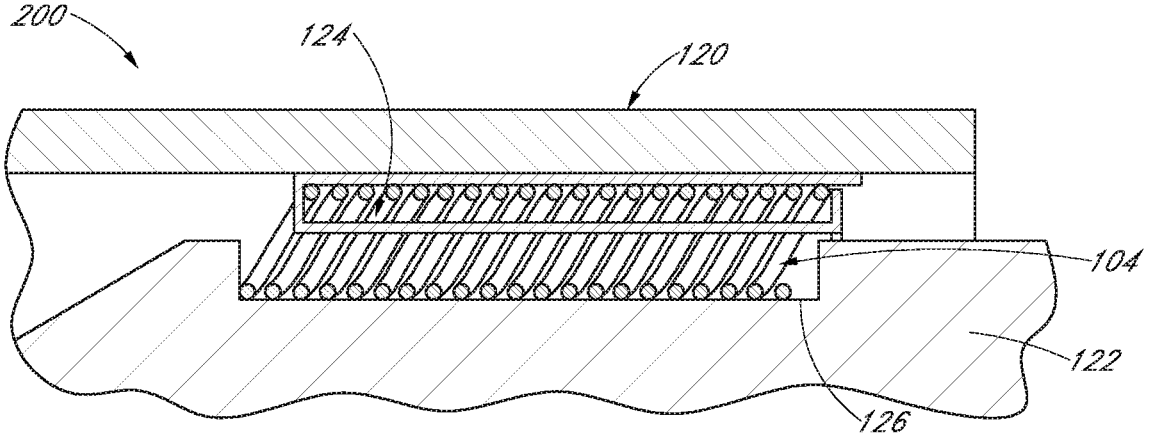

FIG. 3C shows a partial side cross-sectional view of the connector of FIG. 3A, which more clearly shows the coils of the spring section being compressed by at least two surfaces, such as the bottom wall of the channel and the interior surface of the housing or the outer finger section of the finger 104. When so compressed, the canted coils of the spring section are further canted. In other words, the coils have a first canting position when not biased by the at least two surfaces. But when compressed by the at least two surfaces, the coils are further canted from the first canting position to a second canting position.

Figure 4:
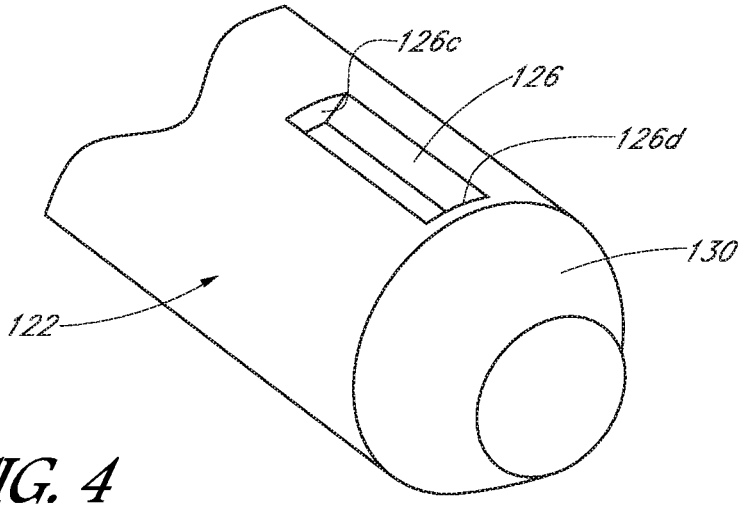
FIG. 4 is a partial perspective view of a pin having a recessed channel or slot for receiving a spring section.

FIG. 4 is a partial perspective view of a pin 122 provided in accordance with aspects of the present disclosure. A slot 126 can clearly be seen formed with the pin 122. The slot or channel 126 can have sidewalls walls 126*a*, 126*b*, a bottom wall 126*c* (FIG. 3B), and two end walls 126*d*, 126*e*. In an example, there can be as many slots formed with the pin 122 as there are fingers formed with a retaining component 100. In other examples, there can be more slots than there are fingers on the retaining component.

Thus, aspects of the present disclosure is understood to include a connector that can comprise one or multiple canted coil spring lengths each with two ends that are not connected with corresponding number of slot or slots made in the pin to accept the spring lengths upon connection of the pin to a housing. Each spring length can be mounted onto a finger of a retaining component, which has a body defining a ring that can be continuous or can have a gap. The pin can be locked from removal from the housing once inserted into the ring and the housing and the one or more spring lengths seated within the one or more slots on the pin. In other examples, the pin can be removed from the housing after the one or more spring lengths are seated within the one or more slots on the pin With reference against to FIGS. 3B, 3C and 4, where the sidewalls 126*a*, 126*b* of a channel 126 are provided with only straight walls, the pin 122 can be locked to the housing 120 and cannot be removed therefrom. In other words, with only straight sidewalls utilized for the one or more slots or recessed channels, the spring lengths cannot further deflect by the straight sidewalls to cause the coils to further cant to enable the spring lengths to escape from the slots. More specifically, when the pin 122 is pulled in the axial direction in an attempt to move away from the housing 120, the spring section 124 is constrained by the two sidewalls 126*a*, 126*b* and by the two end walls 126*c*, 126*d* of the recessed channel 126. When the pin is rotated, clockwise or counter-clockwise, the vertical sidewalls will contact the spring section 124 near the major axes of the plurality of coils. However, since a radial canted coil spring cannot deflect when pushed at or near the major axes of the coils, the canted coil spring section cannot deflect and therefore cannot escape from the confinement of the recessed channel.

In the embodiment where the slot or recessed channel 126 is provided with at least one tapered sidewall, as shown in FIG. 3B, the pin can first be rotated, such as rotated clockwise from the position of FIG. 3B, around the lengthwise axis of the pin. Once rotated, the tapered sidewall 126*b* of the recessed channel pushes against the coils at a location away from the major axes of the coil to deflect the coils. The closer the tapered sidewall 126*b* is to the minor axes of the coils of the spring section, the lower the force is required to lift the coils or to further deflect the coils. Once the coils are defected by the rotation of the pin to move the tapered sidewall 126*b* into the coils to cant the coils, the height profile of the coils decreases to about the dimension of the clearance gap 136. This then allows the pin 122 to be removed from the housing 120 as the further deflected coils provide clearance to enable movement away from the holding of the recessed channel 126. The pin can then move axially away from the housing.

If there are two recessed channels 126 incorporated with the pin 122, such as shown in FIG. 3A, the slanted or tapered sidewalls of the two recessed channels should be arranged so that the same rotation of the pin moves both slanted sidewalls for the two recessed channels into contact with the corresponding spring sections to lift the coils to enable separation of the pin from the housing. The slanted sidewalls allow the pin to rotate the recessed channels radially away from the fingers 104 and away the spring sections 124, which are held by the fingers of the retaining component 100.

Figure 5:
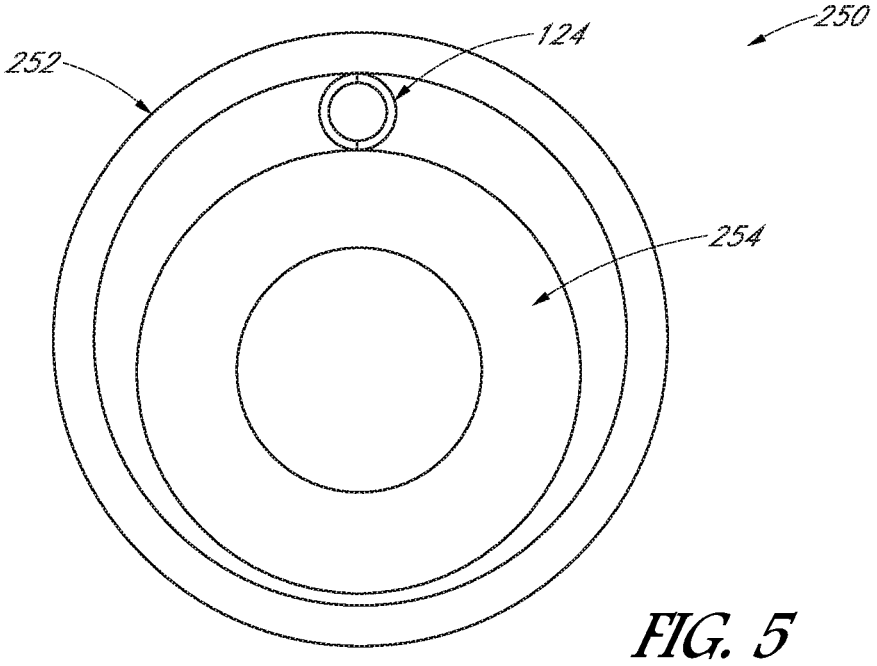
FIG. 5 is an end view or cross-sectional end view of an electrical connector assembly with a single spring length.
Figure 6:
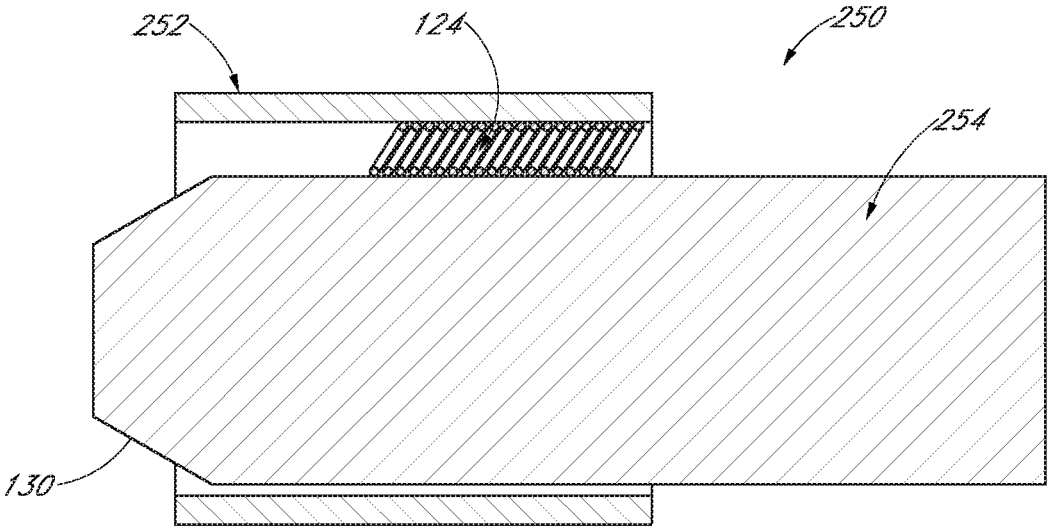
FIG. 6 is a cross-sectional side view of the electrical connector assembly of FIG. 5.

FIG. 5 shows an alternative connector assembly 250 provided in accordance with further aspects of the present invention. FIG. 6 is a cross-sectional side view of the connector assembly 250 of FIG. 5 As shown, the connector assembly 250 comprises an elongated cylindrical housing 252, a pin 254, and a spring length 124. The housing 252 has a bore and receives the pin 254 therein. In the present alternative embodiment, a retaining component is omitted. Further, a slot on the pin is omitted. Instead, the spring length 124 is held between the housing and the pin via friction. The spring length causes the pin to be held off-axis from the central axis of the housing. Also, the housing, the pin, or both the housing and the pin can serve as an electrical connector without a groove or a channel. Said differently, the electrical connector of FIGS. 5 and 6 show a straight pin, a spring length rather than spring ring, and a straight housing.

In an example, the pin 254 can have a hollow core as shown in FIG. 5 or alternatively can have a solid core or be solid throughout. The pin can have a tapered insertion end, similar to that shown in FIG. 4, to facilitate insertion of the pin into the bore of the housing.

In an example, the spring length 124 of FIGS. 5 and 6 causes the pin 254 to seat eccentrically relative to the center of the housing 152. Compared to a conventional canted coil spring based electrical connector that utilizes a canted coil spring in a garter or ring configuration, where two ends of a spring length are joined, the present connector assembly 250 can allow for a smaller overall connector package or profile since the spring length on only one side of the pin as opposed to being circumferentially around the pin requires less space thereby allowing for a design with a smaller overall profile.

In some examples, two or more spring sections, each in a spring length configuration, can be incorporated with the connector assembly but in unequally spaced configuration and still provide for an off-axis connection, which allows for a relatively smaller connector profile. For example, using a 0-360 degree scale, two spring sections can be mounted at 320 degrees and at 20 degrees or three spring sections can be mounted at 290 degrees, at 0 degree, and at 20 degrees and provide for an off-axis connection.

In an example, brackets, rings, or other surface features may be provided to retain the spring length within the housing so that the spring length does not dislodge from the housing upon insertion of the pin. When the pin is connected to the housing as shown in FIGS. 5 and 6, the pin simultaneously contacts the spring along one side of the pin and against the interior of the housing on the opposite side of the pin to complete the communication between all three components.

Figure 7:
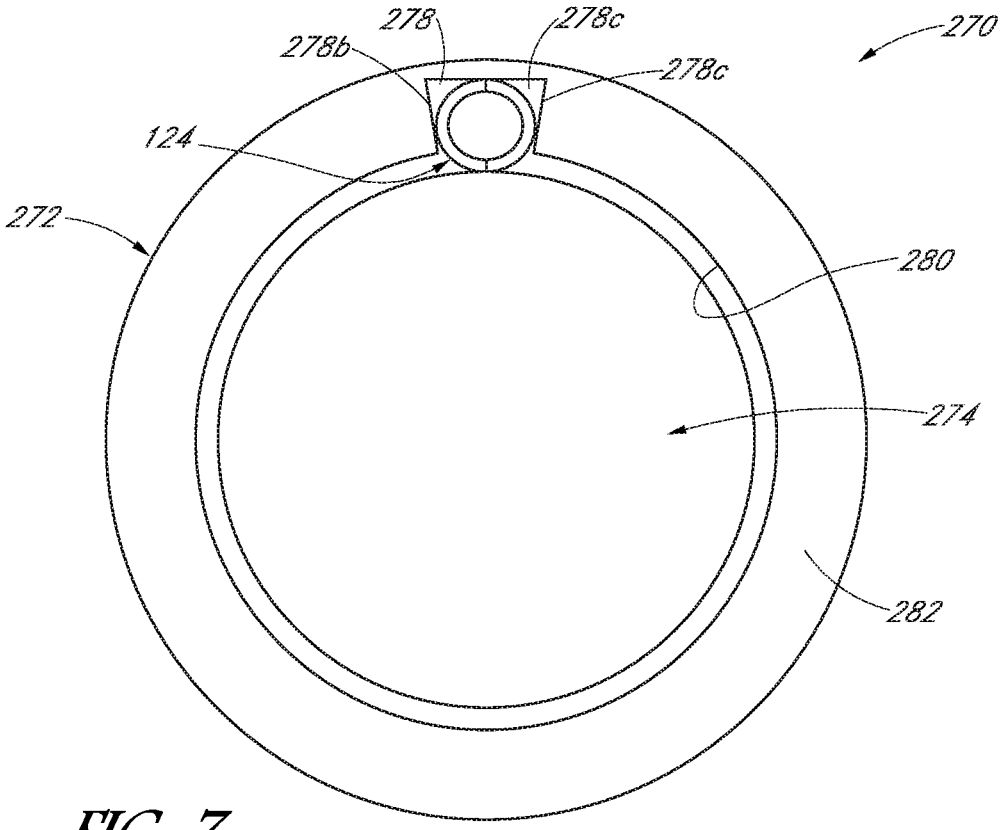
FIG. 7 is an end view or cross-sectional end view of an electrical connector assembly with a single spring length located in a recessed channel or slot of the housing.

With reference now to FIG. 7, an alternative connector assembly 270 provided in accordance with further aspects of the present invention is shown. The connector assembly 270 can comprise a housing 272, a pin 274, and a spring length 124, similar to other embodiments described elsewhere herein. In the present embodiment, only a single spring length 124 is shown with additional spring lengths contemplated. For example, a second spring length or a third spring length, or additional spring lengths, can be incorporated and placed in spaced apart relationship to the spring length shown inside the bore of the housing 272. The spacing between the spring lengths can be equal or unequal around the interior of the housing.

The pin 274 can have a tapered insertion end and a solid core, as shown, or can have a hollow core. The pin, the housing, and the spring length or lengths can all be made from the same or different electrically conductive material to function as an electrical connector and optionally for EMI shielding.

The housing 272 of FIG. 7 is shown with a recessed channel 278 formed on the interior surface 280 of the housing 272. The housing has a wall 282 with a wall thickness. The recessed channel 278 can be formed in the wall thickness of the wall 282, such as by machining the channel lengthwise parallel the axis of the bore of the housing. In other examples, the length of the recessed channel 278 can be angled and not parallel to the axis of the bore of the housing. This off-axis configured channel can require greater insertion and removal forces when inserting or retracting the pin from the housing. In some examples, there can be two or more recessed channels formed in the wall thickness of the housing.

As shown, the recessed channel has two sidewalls 278*a*, 278*b* and a bottom wall 278*c* located between the two sidewalls. The two sidewalls 278*a*, 278*b* are shown having an acute angle with the bottom wall 278*c*. Such configured sidewalls for the indicated channel 278 can be referred to as a dovetail channel or groove. However, the groove, as used herein, is understood to be non-annular or not ring shape for accommodating a spring length rather than a spring ring. In other examples, the channel 278 has two sidewalls and a bottom wall with a generally U-shape, wherein the two sidewalls are generally parallel to one another.

The channel 278 has an entrance that is reduced by the two corner edges of the two tapered sidewalls 278*a*, 278*b*, which is common in a dovetail groove. The reduced entrance is configured to prevent the spring length 124 from dislodging from the channel when the pin 274 is not disposed inside the bore. The channel 278 can have one end wall, which can be the surface where the cutting tool stops cutting into the wall thickness of the housing to form the channel. The channel can also include retention surfaces to prevent the spring length from displacing out of the channel upon retraction of the pin from the housing. In an example, the sidewall surfaces that contact the spring length can be the retention surfaces. In other examples, roughened knurls formed with the sidewalls 278*a*, 278*b* can serve as the retention surfaces.

Figure 8:
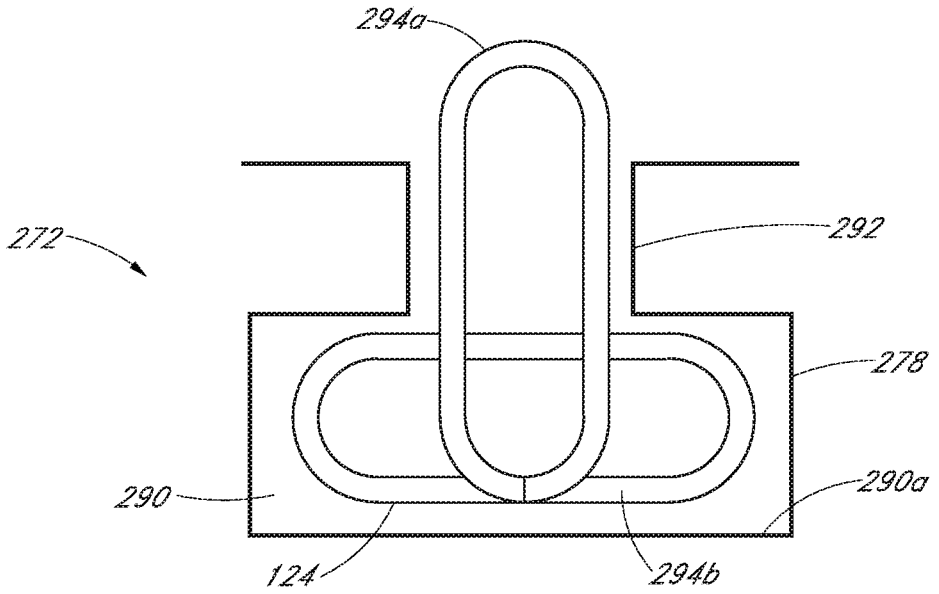
FIG. 8 is a partial schematic view of an alternative recessed channel or slot of a housing and a canted coil spring section with a complex coil shape located in the recessed channel.

With reference now to FIG. 8, an alternative recessed channel 278 formed in the wall thickness of a housing 272 (shown schematically only) with an alternative spring length 124 are shown. The channel 278 has a generally rectangular shape bottom section 290 and a vertical section 292 generally resembling an upside-down T. The groove can be considered a T groove, which is not in an annular configuration. The T groove shaped channel 278 is sized and shaped to receive a matching alternative canted coil spring length 124 having a plurality of coils 294*a*, 294*b* that are all canted generally in the same direction. Additionally, the coils have been rotated so that a first sub-set of coils 294*a* are vertically positioned and a second sub-set of coils 294*b* are horizontally positioned, both relative to the bottom wall 290*a* of the bottom section 290. The plurality of coils have a generally T-shape configuration and can readily fit inside the T-groove shaped channel 278. The plurality of coils can alternate sequentially between vertical coils and horizontal coils in a 1 to 1 ratio or in different ratios, such as two vertical coils then one horizontal coil, three vertical coils then one horizontal coil, two vertical coils then two horizontal coils, etc.

Additional aspects of the coil length having the T-shape configuration of FIG. 8 are described in co-pending publication No. US2017/0025779, entitled CANTED COIL SPRINGS, CONNECTORS, AND RELATED METHODS, filed Oct. 4, 2016, the contents of which are expressly incorporated herein by reference. The '779 publication discloses a number of different complex canted coil spring shapes. These canted coil springs with complex coil shapes in a spring length configuration rather than a spring ring configuration can also be used with the connector assemblies of the present disclosure. For example, the triangular shaped coils of FIG. 37 and the three leaf clover shaped coils of FIG. 47 of the '779 publication can be used with the T-groove shaped channel 278 of FIG. 8 in the same way as the spring length of FIG. 8 is used, possibly with some modification to the channel to ensure fit with the different coils. Indeed, any of the various canted coil springs disclosed in the '779 publication in a spring length configuration can be used with the connector assemblies of the present invention.

FIGS. 9A-9D show an alternative housing 300 for use in an electrical connector assembly. The present housing 300 serves the same purpose as other housings discussed elsewhere herein, such as the housing 120 of FIGS. 2, 3A, 5, and 7. However, in the present embodiment, the body 302 of the housing 300 is made by rolling a prepared metal sheet 298 into a rolled form to form an elongated cylinder with a bore 304 and a lengthwise gap 308. The prepared metal sheet 298 is understood to be a metal sheet having cut-outs and edges for rolling to form the final housing structure, as further discussed below. The present housing 300 further includes a finger 306 having a free end 114 and a bent retaining tip 114*a*. The finger 306 can be unitarily formed with the body 302 that forms the housing.

Figure 9A:
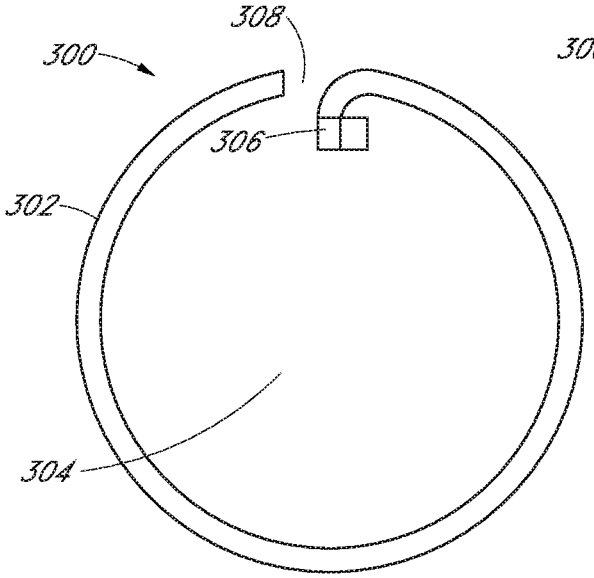
FIGS. 9A-9D show different views of a housing for use in an electrical connector assembly with a finger for retaining a spring section.
Figure 9B:
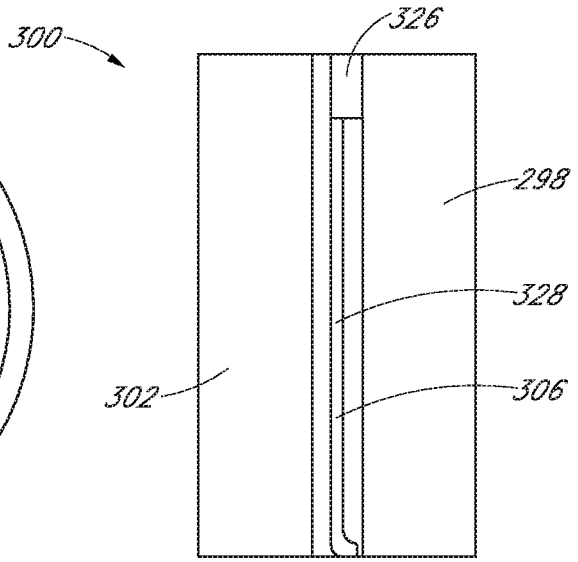
Figure 9C:
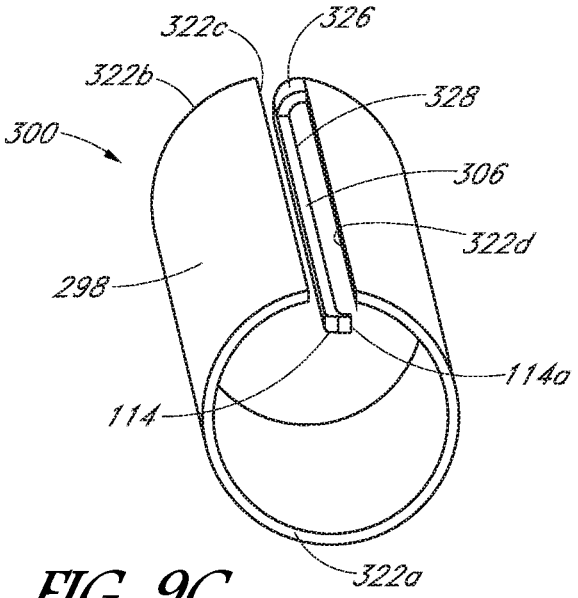
Figure 9D:
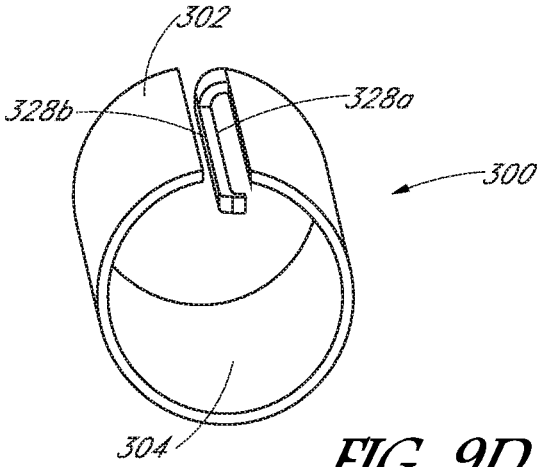

In an example, the body 302 is formed by first preparing a metal sheet having two end edges 322*a*, 322*b* and two side edges 322*c*, 322*d* (FIG. 9C). An extension piece 326 extends from one of the side edges 322*c*, 322*d* and an elongated piece 328 extends from the extension piece 326. In an example, the extension piece 326 has a length that extends about 0.05 to 0.40 time the length of the housing measuring between the two end edges 322*a*, 322*b*. The elongated piece 328 has a length that can be shorter than, equal to, or longer than the length of the housing measuring between the two end edges 322*a*, 322*b*. As shown, the length of the elongated piece 328, connected to the extension piece 326, is longer than the length of the housing. However, when the retaining tip 114 is formed by bending the elongated piece 328, the final length of the finger 306 can be about the same as the length of the housing, as shown in FIG. 9B.

Further as shown, the bent retaining tip 114*a* can be rotated so that the end most point of the retaining tip projects towards one of the side edges 322*a* or 322*b* and not radially outwardly beyond the outer perimeter of the housing and stick out beyond the outer contour of the housing, which can possibly interfere with installation or assembly of the housing. However, the end most point of the retaining tip 114*a* can be rotated differently than as shown.

The elongated piece 328, or the finger 306 formed by the elongated piece, has two side edges 328*a*, 328*b* that are spaced from adjacent edges of the body 302. For example, the two side edges 328*a*, 328*b* of the unitarily formed finger 306 are spaced from the two side edges 322*a*, 322*b* of the housing 300. The gaps between the finger and the two side edges 322*a*, 322*b* of the housing can be selected based on the size of a canted coil spring length for use with the housing.

Thus, aspects of the present embodiment is understood to include a housing 300 formed by rolling a metal sheet and having a unitarily formed finger 306. The housing can have two end edges 322*a*, 322*b* and two side edges 322*c*, 322*d*. The finger 306 can also have two edges 328*a* 328*b* and wherein the two edges of the finger 306 are spaced from the two side edges 322*c*, 322*d* of the housing.

In use, a canted coil spring length can be mounted onto the finger 306 and a pin, such as one of the pins disclosed elsewhere herein, can be inserted into the bore 304 of the housing 300 to complete the electrical connection.

Figure 9E:
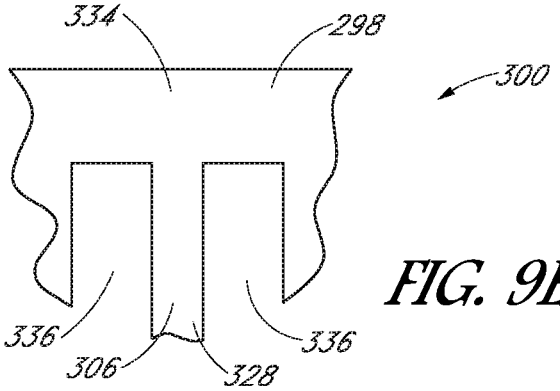
FIG. 9E is a partial schematic view of an alternative finger for use with the housing of FIGS. 9A-9D.

In some examples, as shown in FIG. 9E, a second unitarily formed finger can be incorporated with the housing 300. For example and in addition to the finger 306 and extended piece 326 shown in FIGS. 9A-9D, a connecting piece 334 and an elongated piece 328 can be included by forming two cut-outs 336 in the prepared metal sheet 298, which defines an elongated piece 328 extending from the connecting piece 334. The elongated piece 328 can serve as the second unitarily formed finger 306 of the alternative housing.

Figure 10A:
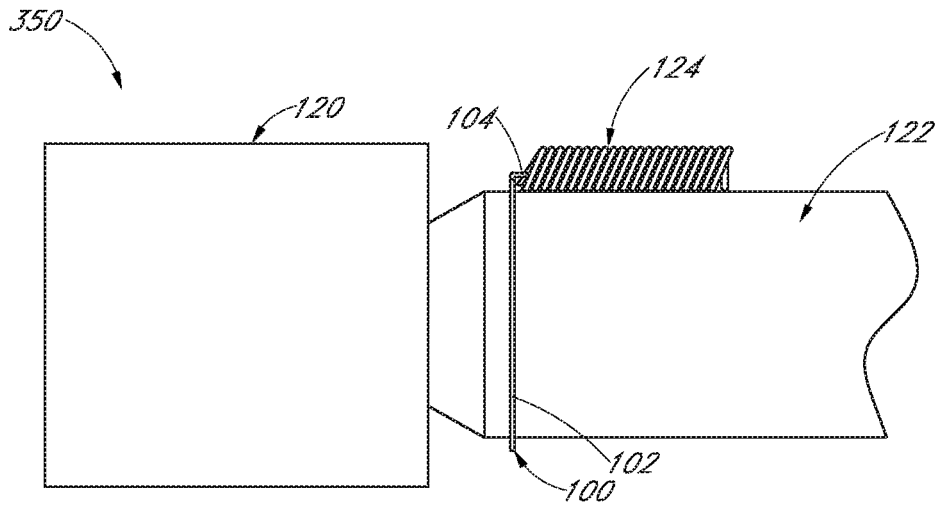
FIG. 10A is a side view of an electrical connector assembly in which the retaining component is pin mounted.
Figure 10B:
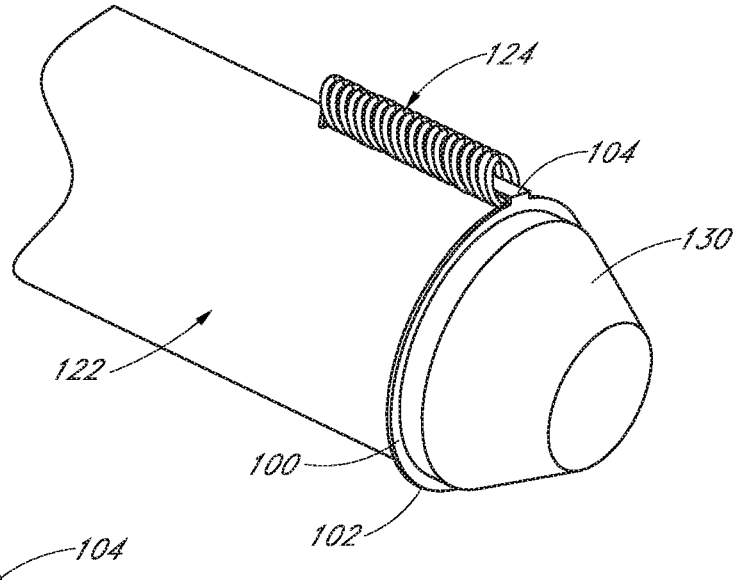
FIGS. 10B and 10C are different views of the pin of FIG. 10A.
Figure 10C:
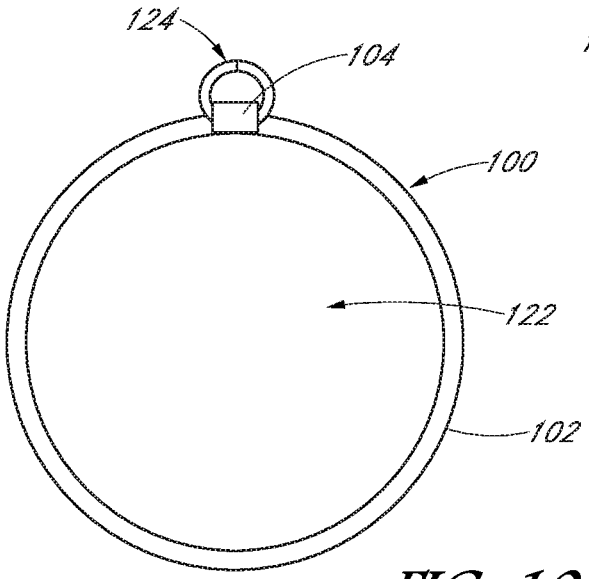

FIG. 10A shows an electrical connector assembly 350 provided in accordance with further aspects of the prevention invention, shown with a housing 120, a pin 122, a retaining component 100, and a canted coil spring section 124. The pin 122 is in the process of either being inserted into the bore of the housing 120 or being removed from the bore of the housing. FIG. 10B is a perspective view of the pin 122, the retaining component 100 and the spring section 124 of FIG. 10A, shown without the housing. FIG. 10C is a cross-sectional end view of the pin 122 shown with the ring 102 of the retaining component 100 mounted around the pin and the spring section 124 mounted on a finger 104 of the retaining component and in contact with the exterior of the pin.

The present connector assembly 350 is similar to the connector assembly of FIGS. 5 and 6 with a few exceptions. The pin 122 of the present embodiment has a solid core but can otherwise have a hollow core as shown in FIG. 5. Further, rather than mounting the retaining component 100 to the housing 120, as shown in FIG. 2, the retaining component of the present embodiment is pin mounted. In other words, as shown in FIG. 10B, prior to insertion of the pin into the housing, the retaining component 100 is mounted on the pin such that the ring 102 surrounds the pin and the spring length 124, located on the finger 104 of the retaining component, is in contact with the pin. The ring 102 can have a friction fit or a slight interference fit with the pin. The pin 122 with the retaining component 100 and the spring section 124 can now be inserted into the bore of the housing 120 (FIG. 10A) to complete the electrical connection.

Figure 11:
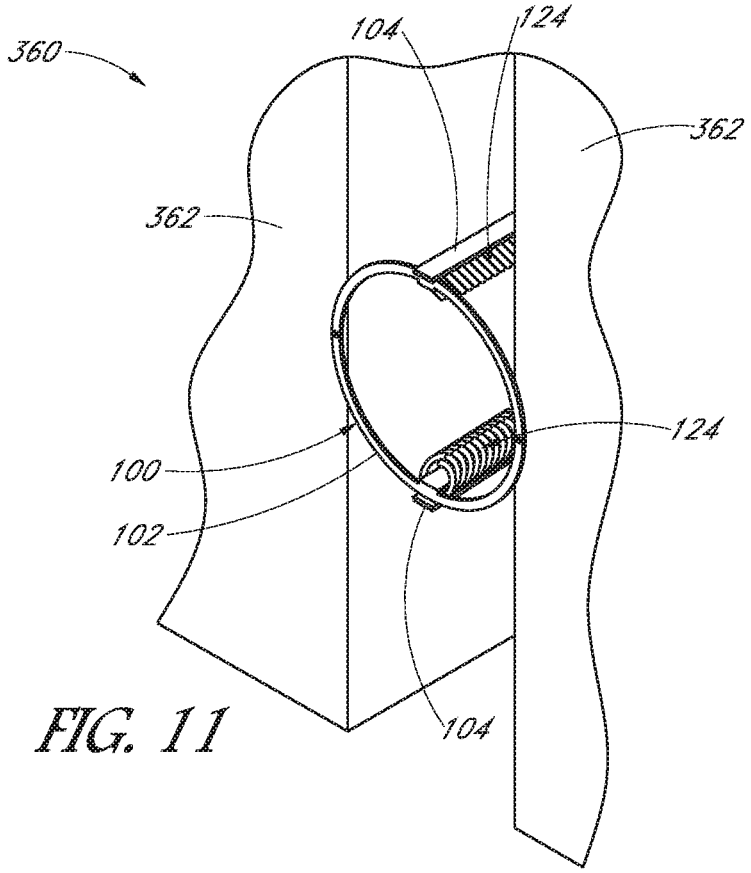
FIG. 11 depicts an alternative mounting of a retaining component.

With reference now to FIG. 11, another alternative electrical connector assembly 360 in accordance with further aspects of the present invention is shown. In the present embodiment, a retaining component 100, which can be similar to one of the components of FIGS. 1A-1C, is secured to a hardware 362, which can be any number of components such as a chassis, a frame, two circuit boards, a mother board, etc. For example, the ring 102 of the retaining component 100 can have two fastener holes for use with fasteners to secure the retaining component to the hardware 362. One or more fingers 104, such as the fingers 104 of FIG. 1A, can extend from the ring and into the gap between the two sections of the hardware. The hardware 362 therefore can function as a housing by holding the retaining component 100 that can receive a pin.

When a pin is inserted into the central opening of the ring 102, electrical connection can be made between the hardware and the pin via the two spring sections 124 and the retaining element 100. For example, a power source or a controller, or a circuit board connected to the pin can be placed in electrical communication with the hardware 362 by placing the pin into the opening 110 of the retaining component 100 to bias the two canted coil spring sections 124 between the exterior surface of the and the respective outer finger section of each finger 104. In some examples, only a single finger and a single spring section are incorporated. In other examples, more than two fingers 104 and more than two spring sections 124 can be incorporated.

Figure 12:
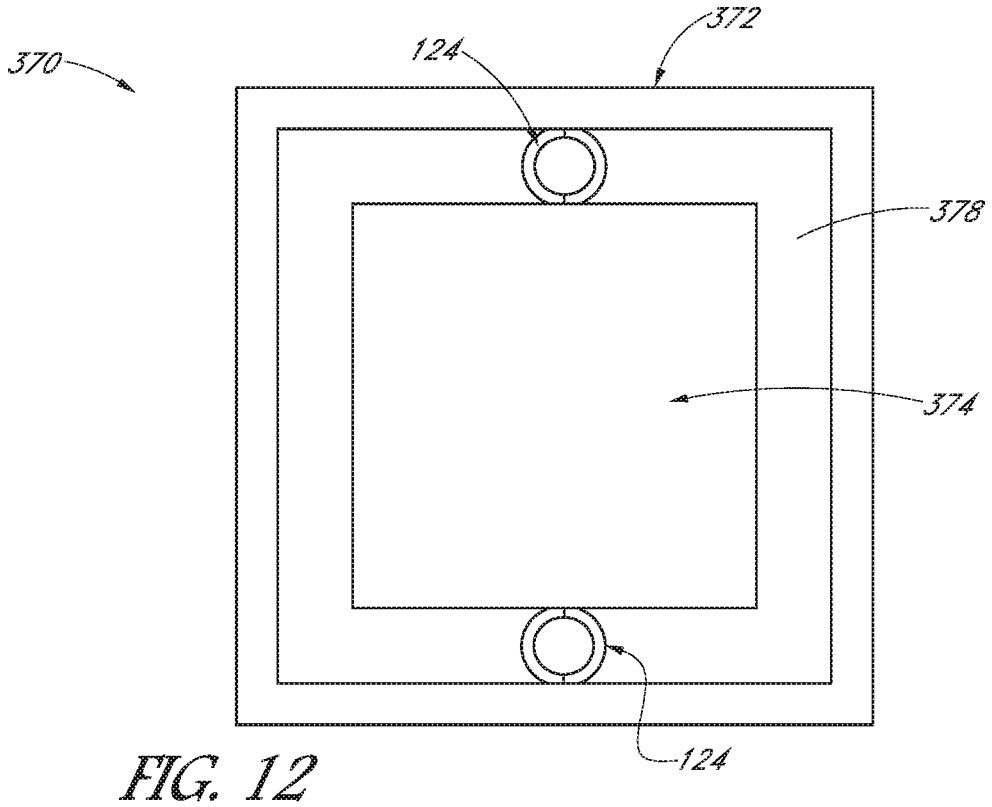
FIG. 12 shows an end view or a cross-sectional end view of an electrical connector assembly in which the housing and the pin both have polygonal shapes.

With reference now to FIG. 12, another alternative electrical connector assembly 370 provided in accordance with further aspects of the prevention invention is shown. The present connector assembly 370 has a housing 372, a pin 374, and two canted coil spring sections or lengths 124. Optionally, there can be one canted coil spring section 124 or more than two canted coil spring sections 124 that can be used with the present connector. Further, while a retaining component is not shown, a retaining component comprising a ring and one or more fingers can be incorporated with the present connector assembly 370 for receiving one or more canted coil spring sections or lengths.

The end view of the electrical connector assembly 370 of the present embodiment is similar to the connector assembly 200 of FIG. 3A in that both connector assemblies have the same components. The present electrical connector assembly 370, however, is not circular. Instead, the housing 372 and the pin 374 are both polygonal in shape. As shown, the housing 372 is generally square in shape but can be rectangular. The pin 374 can have a shape that matches the shape of the housing but can differ as the clearance gap 378 between the interior of the housing and the exterior of the pin allows for some variation in the shape of the pin. Both the housing and the pin can also have an elliptical shape or other multi-sided shapes. The pin 374 can have a tapered insertion end to facilitate inserting the pin into the bore of the housing 372.

In an example, the pin 375 can incorporate recessed channels or slots for retaining the spring lengths 124. In another example, the housing can incorporate recessed channels for retaining the spring lengths 124. In still other examples, a retaining component having a ring and two fingers for retaining the two spring lengths 124 can be incorporated. The ring can have a polygonal shape. The ring can have a matching shape as the housing to seat against the interior of the housing or can have a matching shape as the pin to seat around the exterior surface of the pin.

The present connector assemblies allow for a smaller overall profile compared to prior art connectors with a standard canted coil spring ring connector having the same spring coil size by not utilizing the spring in a spring ring configuration. Further, since a single spring coil height can be used instead of a spring ring coil height being required circumferentially in a standard canted coil spring connector, the utilization of the spring length, with two free ends that are not connected, helps to maintain a relatively smaller profile.

Methods of using the connector assemblies and components thereof described herein and of making the connector assemblies and components thereof are within the scope of the present invention.

Although limited embodiments of the electrical connector assemblies and their components have been specifically described and illustrated herein, many modifications and variations will be apparent to those skilled in the art. For example, the various housings may incorporate recessed channels in which the axis of the channels are angled from the lengthwise axis of the housing, the various pins may incorporate recessed channels in which in which the axis of the channels are angled from the lengthwise axis of the pin, etc. Furthermore, it is understood and contemplated that features specifically discussed for one connector assembly embodiment may be adopted for inclusion with another connector assembly embodiment, provided the functions are compatible. For example, a retaining component with a split ring may be used in another embodiment shown with a retaining component. Accordingly, it is to be understood that the electrical connector assemblies and their components constructed according to principles of the disclosed devices, systems, and methods may be embodied other than as specifically described herein. The disclosure is also defined in the following claims.

What is claimed is:

1. A connector assembly comprising:

a housing comprising a body with a wall thickness;

a retaining component comprising a ring, a finger, and a spring length with two free ends that are spaced from one another located with the finger, and a pin with a tapered insertion end is positioned through the ring; and wherein the spring length with two free ends contacts the pin and the finger.

2. The connector assembly of claim 1, wherein the pin comprises a recessed slot and the spring length is positioned, at least in part, in the recessed slot.

3. The connector assembly of claim 2, wherein the recessed slot comprises two sidewalls, a bottom wall located between the two sidewalls, and two end walls connected to the two sidewalls.

4. The connector assembly of claim 3, wherein at least one of the two sidewalls is a tapered sidewall and is tapered relative to the bottom wall.

5. The connector assembly of claim 4, wherein the recessed slot is a first recessed slot, and further comprising a second recessed slot located on the pin, said second recessed slot comprising two sidewalls.

6. The connector assembly of claim 1, wherein the ring of the retaining component has a gap.

7. The connector assembly of claim 1, wherein the finger is a first finger and the spring length is a first spring length; and further comprising a second finger connected to the ring and a second spring length; and wherein the second spring length is located with the second finger.

8. The connector assembly of claim 1, wherein the ring contacts an interior surface of the housing before the pin is inserted in a bore of the housing or the ring contacts the pin before the pin is inserted in a bore of the housing.

9. The connector assembly of claim 1, wherein the finger is unitarily formed with the ring.

10. The connector assembly of claim 9, wherein the finger has a first bend, a second bend, and a free end that points in a direction of the ring and away from the second bend.

11. The connector assembly of claim 1, wherein the spring length is a canted coil spring length comprising a plurality of interconnected coils all canted in a same general direction and the housing has a round housing wall or has a polygonal shaped housing wall.

12. The connector assembly of claim 1, wherein the retaining component is formed from a wire or by stamping a metal sheet with one or more cutting dies.

13. The connector assembly of claim 1, wherein the finger has a bend connected to the ring and a free end pointing away from the ring and having a bent retaining tip.

14. The connector assembly of claim 1, wherein the housing comprises a body with a wall thickness, an exterior surface, and an interior surface defining a bore; and wherein a recessed slot is formed with the housing or the pin.

15. The connector assembly of claim 14, wherein the pin is rotatable about a lengthwise axis of the pin to separate from the bore of the housing.

16. A connector assembly comprising:

a housing comprising a body with a wall thickness, an exterior surface, and an interior surface defining a bore, the bore having a lengthwise axis;

a pin comprising a tapered insertion end and an exterior surface defining an exterior diameter;

a canted coil spring length comprising a plurality of interconnected coils all canted along a same direction, the canted coil spring length having free ends that are not connected positioned in a slot, and wherein the spring length is aligned substantially parallel to the lengthwise axis of the bore and located between and in contact with the housing and the pin to complete an electrical path; and wherein the pin, the housing, and the canted coil spring length are made from a same electrically conductive material or from different electrically conductive materials, and wherein the slot is recessed from the interior surface defining the bore of the electrically conductive housing or from the exterior surface of the electrically conductive pin.

17. The connector assembly of claim 16, wherein the slot comprises two sidewalls and a bottom wall located therebetween, a V-shape groove, or a V-shape groove with a subtended surface between two slanted surfaces.

18. The connector assembly of claim 17, wherein the two sidewalls are generally parallel to one another or at least one of the two sidewalls is a tapered sidewall and is tapered relative to the bottom wall.

19. The connector assembly of claim 16, wherein the slot is a first slot and further comprises a second slot spaced from the first slot with a spring length located in the second slot.

20. The connector assembly of claim 16, wherein the housing has a unitarily formed finger and the canted coil spring length is located on the finger.

21. The connector assembly of claim 16, wherein the pin is rotatable about a lengthwise axis of the pin to compress the plurality of interconnected coils of the canted coil spring length from a first canting angle to a second canting angle.

22. The connector assembly of claim 16, wherein the pin has a round cross-sectional shape or a polygonal shape.

23. A method of using a connector assembly comprising:

inserting a singular piece pin having an exterior surface defining an exterior diameter and a tapered insertion end into a bore of a singular piece housing, said housing having an exterior surface, an interior surface defining the bore, and a lengthwise axis or inserting a pin having a tapered insertion end into a bore of a ring retaining component having two fingers extending from the ring such that each of the two fingers is aligned substantially parallel to a central axis of the ring;

placing and contacting a canted coil spring length having two free ends that are not connected with a slot recessed from the interior surface of the housing or from the exterior surface of the pin, wherein the canted coil spring length is aligned substantially parallel to the lengthwise axis of the housing and the pin or contacting two spring lengths each with two free ends and each mounted on a respective one of the two fingers of the retaining component with the pin;

wherein the spring length or the two spring lengths each is a canted coil spring comprising a plurality of interconnected coils.

24. The method of claim 23, wherein the ring of the retaining component is fastened to a hardware.

* * * * *